US007645964B2

(12) United States Patent
Park et al.

(10) Patent No.: US 7,645,964 B2
(45) Date of Patent: Jan. 12, 2010

(54) HIGH FREQUENCY HEAT TREATMENT METHOD FOR FINE BOTTOM-CLOSED HOLE

(75) Inventors: Jong Kwan Park, Daegu (KR); Young Su Jeon, Daegu (KR)

(73) Assignee: Korea Sintered Metal Co., Ltd., Daegu (KR)

( * ) Notice: Subject to any disclaimer, the term of this patent is extended or adjusted under 35 U.S.C. 154(b) by 152 days.

(21) Appl. No.: 11/418,209

(22) Filed: May 5, 2006

(65) Prior Publication Data

US 2007/0215603 A1 Sep. 20, 2007

(30) Foreign Application Priority Data

Mar. 17, 2006 (KR) ..... 10-2006-0024706

(51) Int. Cl.
*H05B 6/02* (2006.01)

(52) U.S. Cl. ..... 219/601; 219/644; 148/570

(58) Field of Classification Search ..... 219/601, 219/635, 642, 643, 644; 266/129, 123, 127; 148/570, 571, 572; 166/248; 381/419; 29/598
See application file for complete search history.

(56) References Cited

U.S. PATENT DOCUMENTS

| | | | | |
|---|---|---|---|---|
| 2,182,799 | A * | 12/1939 | Farr | 29/38 A |
| 2,824,729 | A * | 2/1958 | Emerson et. al. | 266/127 |
| 4,375,997 | A * | 3/1983 | Matz | 148/570 |
| 4,531,987 | A * | 7/1985 | Pfaffmann et al. | 148/571 |
| 4,628,167 | A * | 12/1986 | West | 219/644 |

* cited by examiner

*Primary Examiner*—Quang T Van
(74) *Attorney, Agent, or Firm*—Lowe Hauptman Ham & Berner, LLP

(57) ABSTRACT

A high frequency heat treatment method for a fine bottom-closed hole includes preparing a coil so as to be completely inserted into the fine bottom-closed hole, preparing a core for controlling a magnetic flux within the coil such that the core protrudes from upper and lower sides of the coil, heat-treating a target part of the fine bottom-closed hole under conditions of a heating time of 2~3 seconds, an output power of 200~300 kW, a quenching time of 3~5 seconds, a positive electrode voltage of 4 ~8 kV, and a positive electrode current of 2.0~4.5 A, and quenching the heat-treated part of the fine bottom-closed hole with cooling nozzles fixed around the heat-treated part such that a sufficient amount of cooling water is injected uniformly over the whole heated part with a sufficient pressure via the cooling nozzles.

1 Claim, 7 Drawing Sheets

HIGH FREQUENCY HEAT TREATMENT METHOD FOR FINE BOTTOM-CLOSED HOLE

BACKGROUND OF THE INVENTION

1. Field of the Invention

The present invention relates to a high frequency heat treatment method for fine bottom-closed holes, and, more particularly, to a high frequency heat treatment method, which enables simplification of process and cost reduction via improvement of a conventional high frequency heat treatment method while ensuring high quality.

2. Description of the Related Art

Generally, sintered components for a part requiring high strength are enhanced in mechanical properties via heat treatment in a post process. In particular, high frequency heat treatment has been widely used to enhance a local property of a component having a large volume due to its merits in that it can ensure stable quality and reduce manufacturing costs in comparison to typical heat treatment.

The high frequency heat treatment is a process by which only a target part of a material is transformed to an austenite structure, and then transformed to a martensite structure via quenching under preset operating conditions such as suitable shape and size of a coil, frequency, output power, and time.

For the case of sintered component, the high frequency heat treatment is generally applied to parts such as an outer periphery, a cross-section and a punctured hole of a component, which have shapes allowing easy manufacture of a high frequency coil, to teeth of a chain gear, which allow easy operation of the high frequency heat treatment, and to parts such as a cross-section or an inner surface of a clutch hub, which require wear resistance and stiffness.

However, for the case of a fine bottom-closed hole such as a pin stopper hole used to determine a location of a rotor for a sprocket module of a variable timing valve applied to a vehicle, since it is manufactured by pressing a brush having a high hardness for wear resistance, there occurs a problem of low operation efficiency due to high frequency of defective products, complicated process, and high manufacturing costs.

SUMMARY OF THE INVENTION

The present invention has been made to solve the above problems, and it is an object of the present invention to provide a high frequency heat treatment method, which can be applied to a fine bottom-closed hole to provide wear resistance and stiffness while stably maintaining high quality, thereby achieving reduction of manufacturing costs and improvement of productivity.

In accordance with one aspect of the present invention, the above and other objects can be accomplished by the provision of a high frequency heat treatment method for a fine bottom-closed hole, comprising the steps of: preparing a coil so as to be completely inserted into the fine bottom-closed hole; preparing a core for controlling a magnetic flux within the coil such that the core protrudes from upper and lower sides of the coil; heat-treating a target part of the fine bottom-closed hole under conditions of a heating time of 2~3 seconds, an output power of 200~300 kW, a quenching time of 3~5 seconds, a positive electrode voltage of 4~8 kV, and a positive electrode current of 2.0~4.5 A; and quenching the heat-treated part of the fine bottom-closed hole with cooling nozzles fixed around the heat-treated part such that a sufficient amount of cooling water is injected uniformly over the whole heated part of the fine bottom-closed hole with a sufficient pressure via the cooling nozzles.

BRIEF DESCRIPTION OF THE DRAWINGS

The foregoing and other objects and features of the present invention will be more clearly understood from the following detailed description taken in conjunction with the accompanying drawings, in which.

DESCRIPTION OF THE PREFERRED EMBODIMENTS

Preferred embodiments of the present invention will be described in detail with reference to the accompanying drawings.

Figure 1:
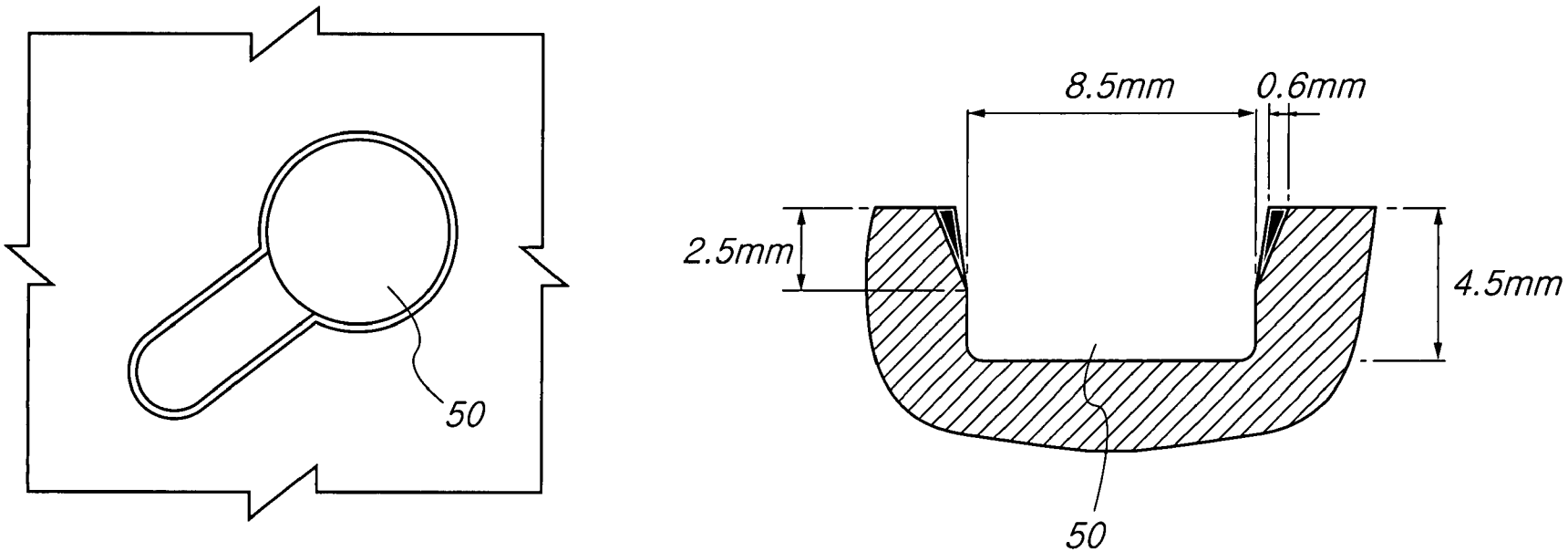
FIG. 1 is a plan view and a cross-sectional view illustrating a fine bottom-closed hole to which a high frequency heat treatment according to the present invention will be applied.
Figure 2:
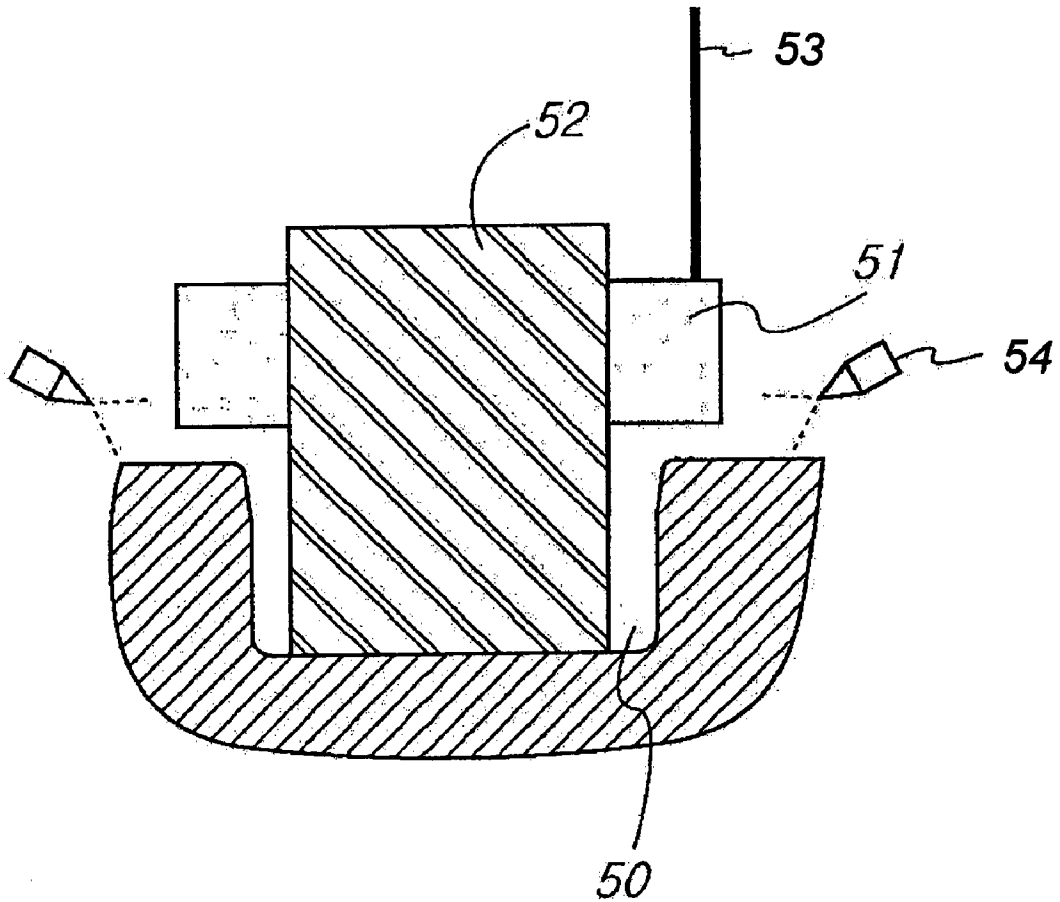
FIG. 2 is a diagrammatic cross-sectional view illustrating a coil used for a high frequency heat treatment method according to a first embodiment of the present invention.
Figure 3:
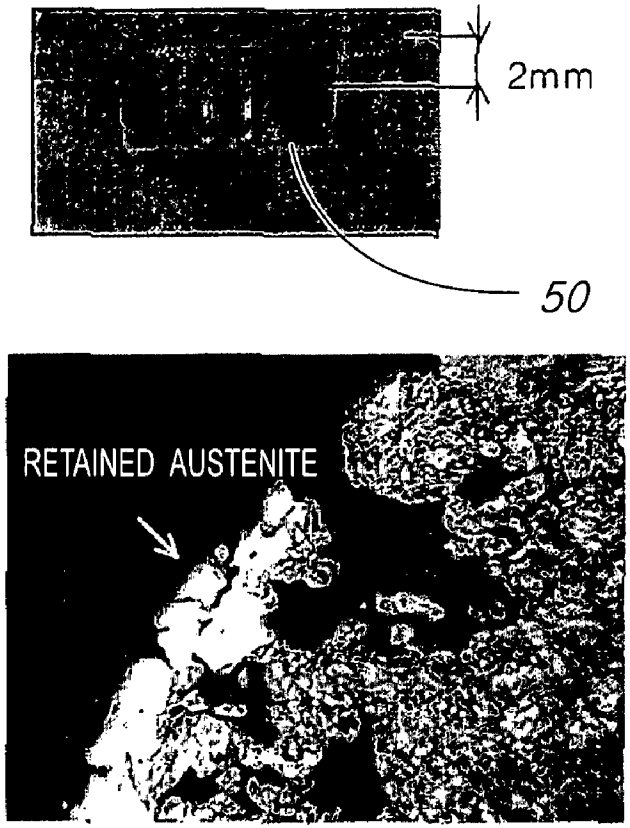
FIG. 3 is views illustrating a cross-section and a structure of the bottom-closed hole to which the high frequency heat treatment according to the first embodiment of the present invention is applied.

FIG. 1 is a plan view and a cross-sectional view illustrating a fine bottom-closed hole to which a high frequency heat treatment according to the present invention will be applied, FIG. 2 is a diagrammatic cross-sectional view illustrating a coil used for a high frequency heat treatment method according to a first embodiment of the present invention, and FIG. 3 is views illustrating a cross-section and a structure of the bottom-closed hole to which the high frequency heat treatment according to the first embodiment of the present invention is applied.

Referring to FIG. 1, a fine bottom-closed hole 50, to which a high frequency heat treatment method of the present invention will be applied, has a diameter of 8.5 mm, and a depth of 4.0 mm, and is required to have a hardening depth of 2.5 mm and a hardening width of 0.6 mm upon high frequency heat treatment. The high frequency heat treatment is performed to satisfy the requirement that thermal influence on other parts is minimized in order to prevent a problem related to machining of an inner diameter or a problem related to an appearance due to the thermal influence from being occurred during a post process after the heat treatment.

According to the first embodiment, high frequency heat treatment is performed using a coil 51 placed above the fine bottom-closed hole 50, and a core 52 for controlling a magnetic flux inserted into a coil 51 such that the core 52 protrudes from upper and lower sides of the coil 51.

The heat treatment is performed under conditions of a heating time of 2~3 seconds, an output power of 200~300 kW, a quenching time of 3~5 seconds, a voltage of a positive electrode 53 of 4~8 kV, and a current of the positive electrode of 2.0~4.5 A.

After performing the heat treatment under the conditions as described above, a cross-section of the fine bottom-closed hole 50 was observed.

As a result, the fine bottom-closed hole 50 has a hardening depth of 2.0 mm which is lower than the target hardening depth, 2.5 mm, and a hardening width of 0.6 mm. In addition, a retained austenite structure was observed at the microstructure of the fine bottom-closed hole 50 due to insufficient cooling of a corner of the fine bottom-closed hole 50 by interference between the coil and cooling water. The retained austenite structure can cause serious defects in functions of a product, such as noise, seizure, and the like.

Thus, it can be evaluated that the high frequency heat treatment of the first embodiment is excellent in terms of manufacturability for operation of the heat treatment, but is not good in terms of quality after the heat treatment.

Figure 4:
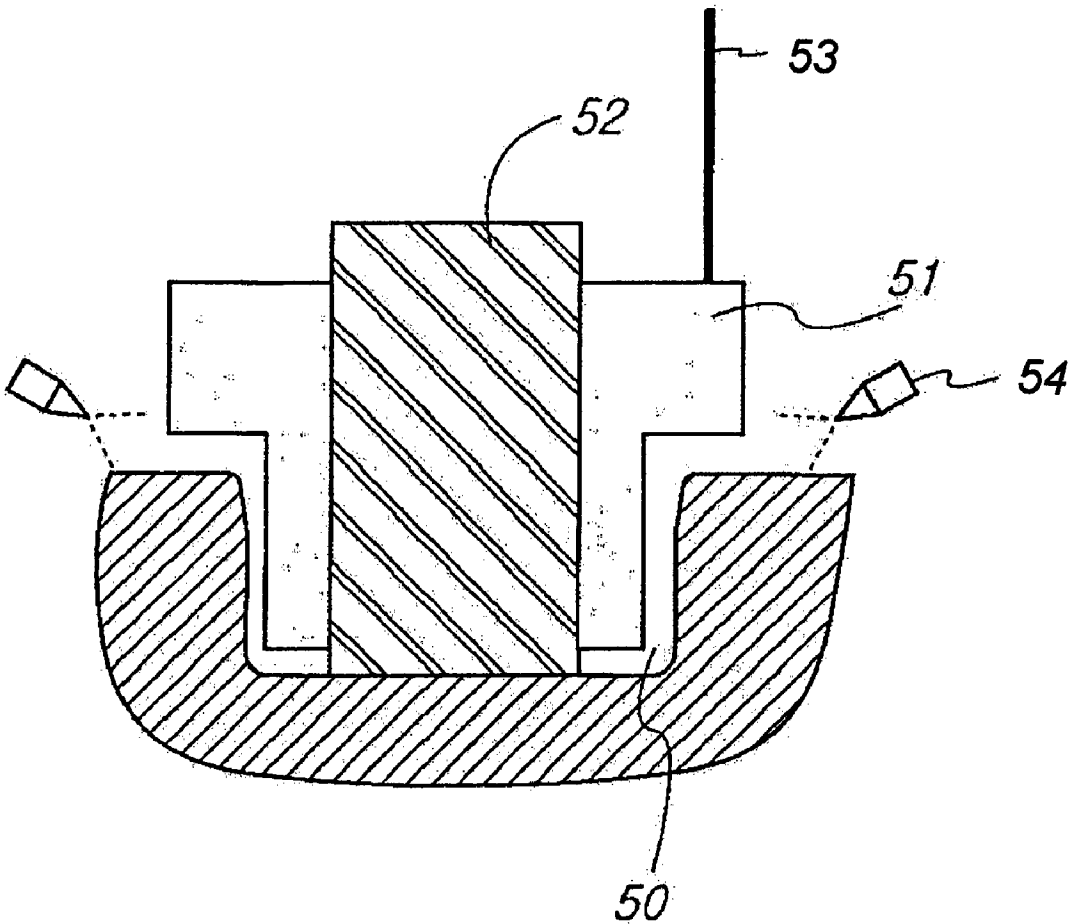
FIG. 4 is a diagrammatic cross-sectional view illustrating a coil used for high frequency heat treatment according to a second embodiment of the present invention.
Figure 5:
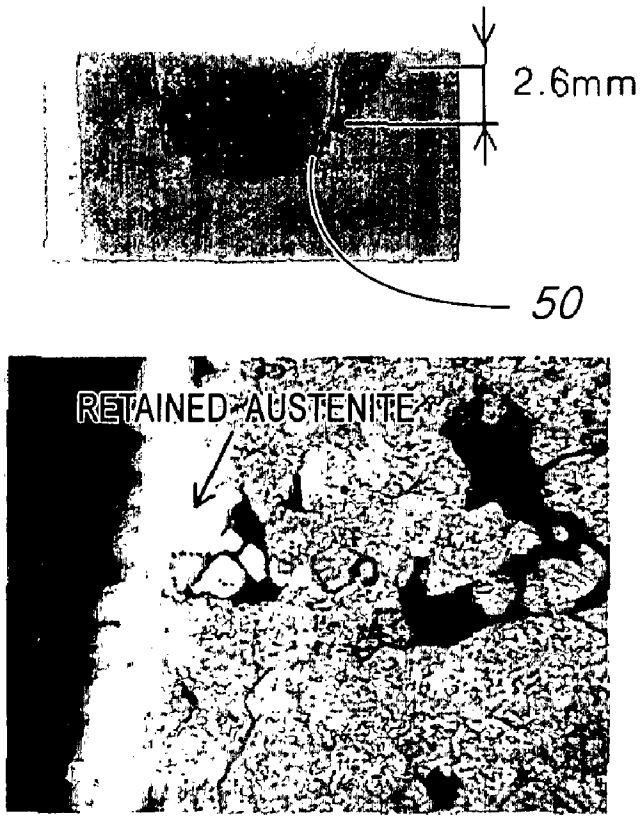
FIG. 5 is views illustrating a cross-section and a structure of the bottom-closed hole to which the high frequency heat treatment according to the second embodiment of the present invention is applied.

FIG. 4 is a diagrammatic cross-sectional view illustrating a coil used for high frequency heat treatment according to a second embodiment of the present invention, and FIG. 5 is views illustrating a cross-section and a structure of the bottom-closed hole to which the high frequency heat treatment according to the second embodiment is applied.

According to the second embodiment, high frequency heat treatment is performed using a coil 51 with a lower portion thereof inserted into the fine bottom-closed hole 50 and an upper portion exposed to an outside, and a core 52 for controlling a magnetic flux placed within the coil 51 such that the core 52 protrudes from upper and lower sides of the coil 51.

The heat treatment is performed under conditions of a heating time of 2~3 seconds, an output power of 200~300 kW, a quenching time of 3~5 seconds, a voltage of a positive electrode 53 of 4~8 kV, and a current of the positive electrode of 2.0~4.5 A.

After performing the heat treatment under the conditions as described above, a cross-section of the fine bottom-closed hole 50 was observed.

As a result, the fine bottom-closed hole 50 has a hardening depth of 2.6 mm, and a hardening width of 1.0~1.4 mm, both of which satisfy the target values. In addition, although a retained austenite structure is also formed at the corner of the product due to decrease in cooling speed caused by interference between the coil and cooling water, the heat treatment of this embodiment provides substantially satisfactory results.

Figure 6:
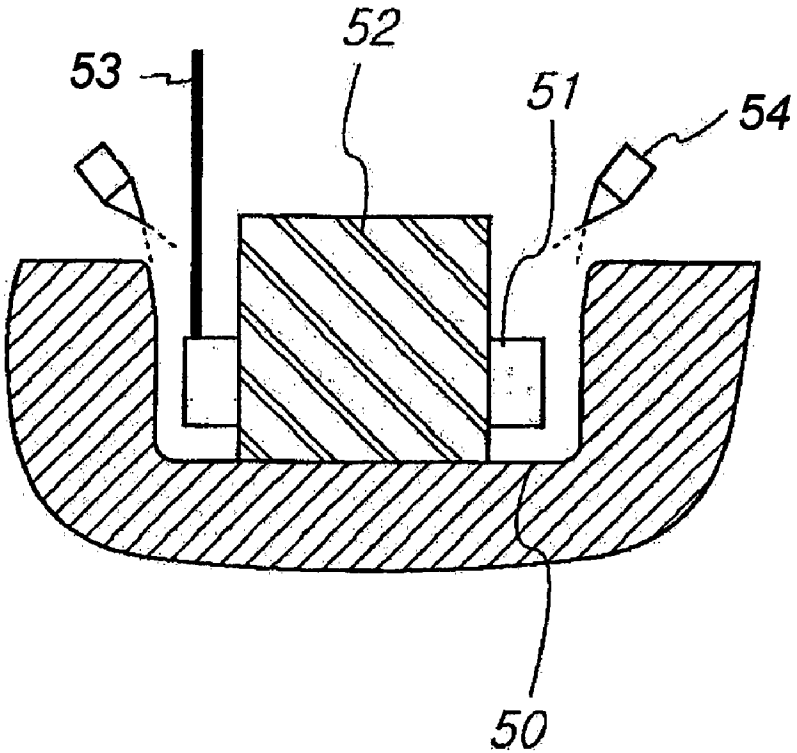
FIG. 6 is a diagrammatic cross-sectional view illustrating a coil used for high frequency heat treatment according to a third embodiment of the present invention.
Figure 7:
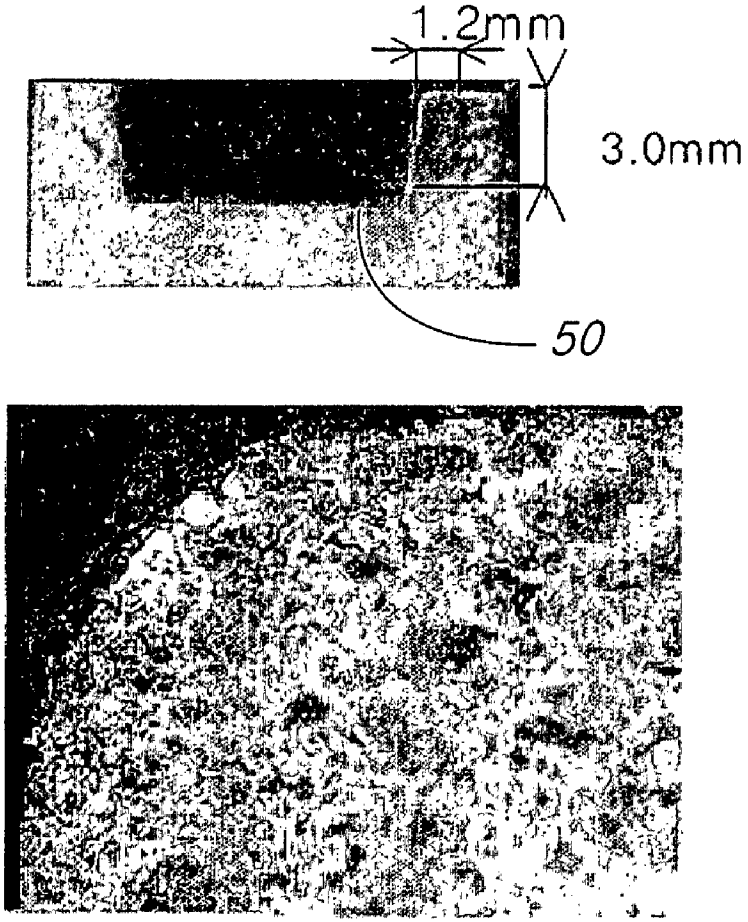
FIG. 7 is views illustrating a cross-section and a structure of the bottom-closed hole to which the high frequency heat treatment according to the third embodiment of the present invention is applied.

FIG. 6 is a diagrammatic cross-sectional view illustrating a coil used for high frequency heat treatment according to a third embodiment, and FIG. 7 is views illustrating a cross-section and a structure of the bottom-closed hole to which the high frequency heat treatment according to the third embodiment is applied.

In the third embodiment, high frequency heat treatment is performed using a coil 51 completely inserted into the fine bottom-closed hole 50, and a core 52 for controlling a magnetic flux placed within the coil 51 such that the core 52 protrudes from upper and lower sides of the coil 51.

In addition, cooling nozzles 54 are disposed around a part to be heat treated such that a sufficient amount of cooling water is injected uniformly over the whole heated part of the fine bottom-closed hole with a sufficient pressure via the cooling nozzles 54 during a quenching step after the heat treatment.

The heat treatment is performed under conditions of a heating time of 2~3 seconds, an output power of 200~300 kW, a quenching time of 3~5 seconds, a voltage of a positive electrode 53 of 4~8 kV, and a current of the positive electrode of 2.0~4.5 A.

After performing the heat treatment under the conditions as described above, a cross-section of the fine bottom-closed hole 50 was observed.

As a result, the fine bottom-closed hole 50 has a hardening depth of 3.0 mm, and a hardening width of 1.2 mm, both of which can be obtained by sufficient processing capability of the heat treatment according to the third embodiment. In addition, with the disposition of the cooling nozzles 54 which allow the heated part to be sufficiently covered with cooling water during the quenching step, the heat treated part is entirely transformed into a martensite structure without the retained austenite.

Although the heat treatment of the third embodiment has a tendency of slightly increasing the manufacturing costs in comparison with the first and second embodiments, the increase in manufacturing costs has substantially negligible influence on the total manufacturing costs.

From results of the heat treatment of the third embodiment, it can be appreciated that the hardening depth and the hardening width satisfy the standard target values, and that the product has excellent quality after being heat treated. In addition, after the heat treatment of the third embodiment, there occurs no problem on a surface or upon inner diameter machining as a post process. Thus, it can be evaluated that the third embodiment is preferred to other embodiments.

From the above description, it can be appreciated that the present invention enables the patterns of high frequency to be determined in addition to the shape of the coil or the core, and prevents the retained austenite from being created, thereby ensuring excellent quality of the product.

As apparent from the above description, the heat treatment method for the fine bottom-closed hole according to the invention has advantageous effects in terms of reduction of manufacturing costs, enhancement of productivity, assurance of high quality as well as wear resistance and stiffness.

It should be understood that the embodiments and the accompanying drawings have been described for illustrative purposes and the present invention is limited only by the following claims. Further, those skilled in the art will appreciate that various modifications, additions and substitutions are allowed without departing from the scope and spirit of the invention as set forth in the accompanying claims.

What is claimed is:

1. A high frequency heat treatment method for a fine bottom-closed hole, comprising the steps of:

preparing a coil so as to be completely inserted into the fine bottom-closed hole;

preparing a core for controlling a magnetic flux within the coil such that the core protrudes from upper and lower sides of the coil;

heat-treating a target part of the fine bottom-closed hole under conditions of a heating time of 2~3 seconds, an output power of 200~300 kW, a quenching time of 3~5 seconds, a positive electrode voltage of 4~8 kV, and a positive electrode current of 2.0~4.5 A; and quenching the heat-treated target part of the fine bottom-closed hole with cooling nozzles fixed around the heat-treated target part such that a sufficient amount of cooling water is injected uniformly over the whole heated part of the fine bottom-closed hole with a sufficient pressure via the cooling nozzles.

* * * * *